US007060337B2

(12) United States Patent
Williamson

(10) Patent No.: US 7,060,337 B2
(45) Date of Patent: Jun. 13, 2006

(54) ADHESIVE ROLLER ASSEMBLY

(75) Inventor: Peter John Williamson, Rexdale (CA)

(73) Assignee: The Evercare Company, Alpharetta, GA (US)

( * ) Notice: Subject to any disclaimer, the term of this patent is extended or adjusted under 35 U.S.C. 154(b) by 123 days.

(21) Appl. No.: 10/820,174

(22) Filed: Apr. 6, 2004

(65) Prior Publication Data

US 2005/0221043 A1 Oct. 6, 2005

(51) Int. Cl.
*A47L 25/08* (2006.01)

(52) U.S. Cl. ..... 428/40.1; 15/104.002; 156/187; 156/188; 156/247; 156/248; 156/255; 428/41.7; 428/43; 428/192; 428/194; 428/906

(58) Field of Classification Search ..... 428/40.1, 428/41.7, 43, 192, 194, 906; 15/104.002; 156/247, 248, 255, 187, 188
See application file for complete search history.

(56) References Cited

U.S. PATENT DOCUMENTS

2004/0134003 A1* 7/2004 McKay, Jr. ..... 15/104.002
2004/0194240 A1* 10/2004 McKay, Jr. ..... 15/104.002

* cited by examiner

*Primary Examiner*—Nasser Ahmad

(74) *Attorney, Agent, or Firm*—Gifford, Krass, Groh, Sprinkle, Anderson & Citkowski, P.C.

(57) ABSTRACT

An adhesive roller for detritus removal having a tubular cylindrical adhesive roll formed by a plurality of overlapping spiral wound layers. Each layer has a backing substrate and an adhesive coating on an outwardly facing side of the sheet. A cover is removably disposed around and has an inner side in contact with the outermost layer of the adhesive roll. The cover has an adhesive release coating on its inner side to reduce adhesion between the cover and the outermost layer of the adhesive roll and two longitudinally extending edges positioned closely adjacent each other when the cover is disposed around the roll. The cover is formed by overlapping spiral wound strips. Additionally, a longitudinally extending adhesive retainer strip overlies the edges of the cover to detachably secure the covers together. A pull-tab is adhesively attached to one side of the retainer strip which enables the cover to be repeatedly removed from and reattached to the adhesive roll.

9 Claims, 2 Drawing Sheets

ADHESIVE ROLLER ASSEMBLY

BACKGROUND OF THE INVENTION

1. Field of the Invention

The present invention relates generally to adhesive roller assemblies of the type used for detritus removal.

2. Description of Related Art

There are many previously known adhesive rollers of the type used for detritus removal. These previously known adhesive rollers are generally of two different type constructions.

In the first type of construction, the adhesive roller comprises an elongated strip having a backing layer with two ends and two spaced-apart and parallel sides. An adhesive coating is provided along one side of the backing layer and the strip is then wound from one end to the other into a tubular and cylindrical roller with the adhesive coating facing outwardly.

In use, the adhesive roller is then moved along the surface to be cleaned and, in doing so, the outermost layer or sheet of the adhesive roll adhesively removes the detritus from the surface being cleaned. After extended use, the adhesive on the outermost sheet becomes spent. When this occurs, the outermost sheet is then removed from the roll thus exposing the next underlying sheet with fresh adhesive until the entire roll is depleted.

In order to protect the outermost sheet of the roll when the roll is not in use, a cover is removably disposed about the adhesive roll. This cover typically comprises a backing layer having an adhesive release coating on its inner surface. The release coating minimizes the adhesion between the cover and the adhesive roll to enable easy removal of the cover from the roll when use of the roller is desired, and the subsequent reattachment of the cover to the adhesive roll after use of the adhesive roller is done.

One disadvantage of this type of previously known adhesive roller, however, is that the manufacturing costs are relatively high. As such, adhesive rollers that are wound end-to-end to form the roll form the premium or more expensive adhesive rollers for detritus removal.

In the second type of adhesive rollers for detritus removal, the adhesive roller is also formed from an elongated strip having a backing layer with a coating of adhesive on an outer side. Unlike the first type of adhesive rollers, however, these rollers are spiral wound to form the adhesive roll. As before, once the adhesive becomes spent on the outermost layer of the adhesive roll, a single spiral winding, which forms the outermost layer or sheet of the adhesive roll, is removed thus exposing the next innermost layer of the spiral wound adhesive roll.

A primary advantage of the spiral wound adhesive roller is that such rollers may be very inexpensively manufactured. A disadvantage, however, of the spiral wound adhesive roller is that the cover disposed around the adhesive roll is also spiral wound. In practice, after the removal of the spiral wound cover when use of the adhesive roll is desired, the replacement of the spiral wound cover on the roll following completion of the use of the roller is difficult to achieve. In some cases, the user of the adhesive roll simply fails to reattach the cover to the roll after use due to the difficulty of replacing the cover. This, however, results in premature depletion of the adhesive coating on the outermost exposed layer of the roll.

SUMMARY OF THE PRESENT INVENTION

The present invention provides a spiral wound adhesive roller which overcomes all of the above-mentioned disadvantages of the previously known adhesive rollers.

In brief, the adhesive roller of the present invention comprises a tubular and cylindrical roll having a plurality of overlapping layers. Each layer comprises a backing sheet and an adhesive coating on an outwardly facing side of the backing sheet. The overlapping layers, furthermore, are formed by spiral winding the backing sheet with its adhesive coating about a tubular and cylindrical core so that one spiral winding forms one layer or sheet on the roll.

A cover is disposed around the outermost layer of the adhesive roll. The cover includes a substrate, preferably made of paper, which is spiral wound around the adhesive roll. An inwardly facing surface of the substrate is coated with an adhesive release coating to minimize or eliminate the adhesion between the cover and the adhesive roll.

An adhesive tape is then spiral wound around the substrate. This adhesive tape, furthermore, has a width substantially the same or slightly less than the width of the substrate so that the edges of the adhesive tape are adjacent each other. In doing so, the adhesive tape adheres to the substrate and forms a cover around the roll.

After the adhesive tape is wound around the substrate, a longitudinally extending slit is made through both the adhesive tape and the substrate thus forming two longitudinally extending abutting edges on the cover. A longitudinally extending adhesive retainer strip is then disposed across the abutting edges of the cover in order to secure the cover to the adhesive roll. Simultaneously, a pull-tab is adhesively attached to one side of the retainer strip to facilitate removal of the cover from the adhesive roll when use of the adhesive roll is desired.

A primary advantage of the present invention is that the entire adhesive roll, as well as its cover, is spiral wound for inexpensive manufacturing costs. However, the cover is generally rectangular in shape which facilitates the removal of the cover from the adhesive roll when use of the roll is desired, as well as replacement of the cover on the roll after use of the roll is done.

BRIEF DESCRIPTION OF THE DRAWING

A better understanding of the present invention will be had upon reference to the following detailed description when read in conjunction with the accompanying drawing, wherein like reference characters refer to like parts throughout the several views and in which.

DETAILED DESCRIPTION OF A PREFERRED EMBODIMENT OF THE PRESENT INVENTION

Figure 1:
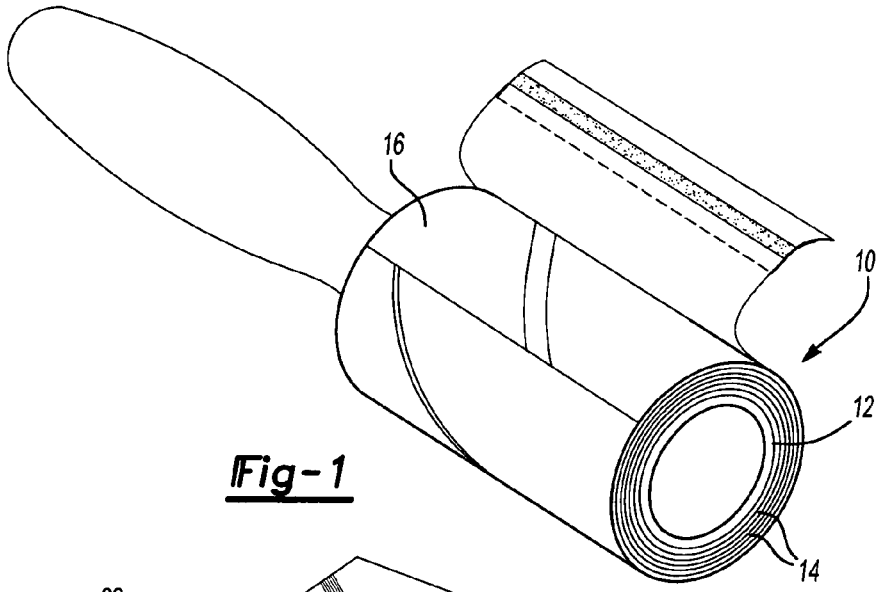
FIG. 1 is an elevational view illustrating a preferred embodiment of the present invention.
Figure 6:
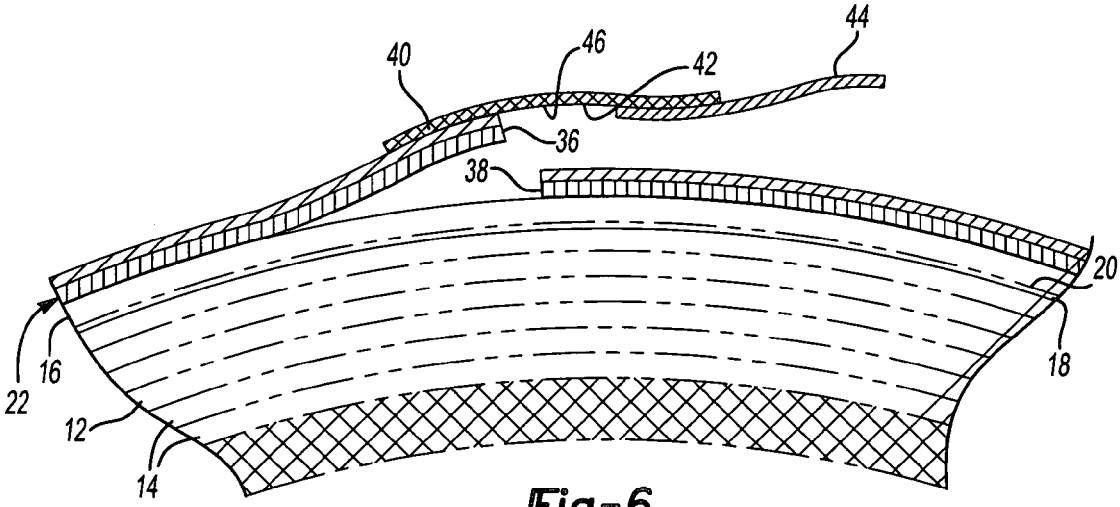
FIG. 6 is a fragmentary sectional end view illustrating the operation of the present invention.

With reference first to FIGS. 1 and 6, a preferred embodiment of the adhesive roller assembly 10 of the present invention is shown and comprises a tubular and cylindrical roll 12 having a plurality of overlapping layers 14. Each layer 14, furthermore, is formed by spiral winding overlapping strips 16 about a tubular and cylindrical core wherein each strip 16 includes a backing sheet 18 with an adhesive coating 20 on an outwardly facing surface of the backing sheet 18. In the well-known fashion, the individual layers, each consisting of one spiral wound strip 16, may be removed from the roll 10 whenever desired to expose the next underlying layer 14 of the adhesive roll 10.

Figure 2:
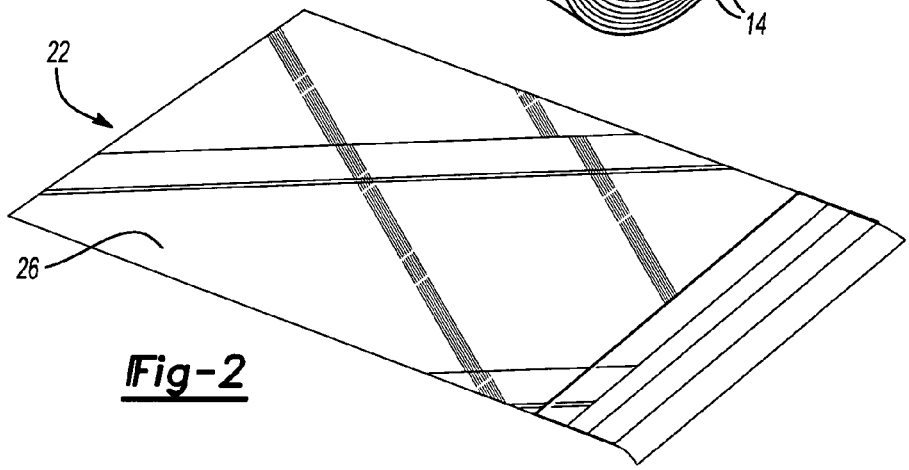
FIG. 2 is an elevational view illustrating a preferred embodiment of the cover of the adhesive roller assembly of the present invention.
Figure 3:
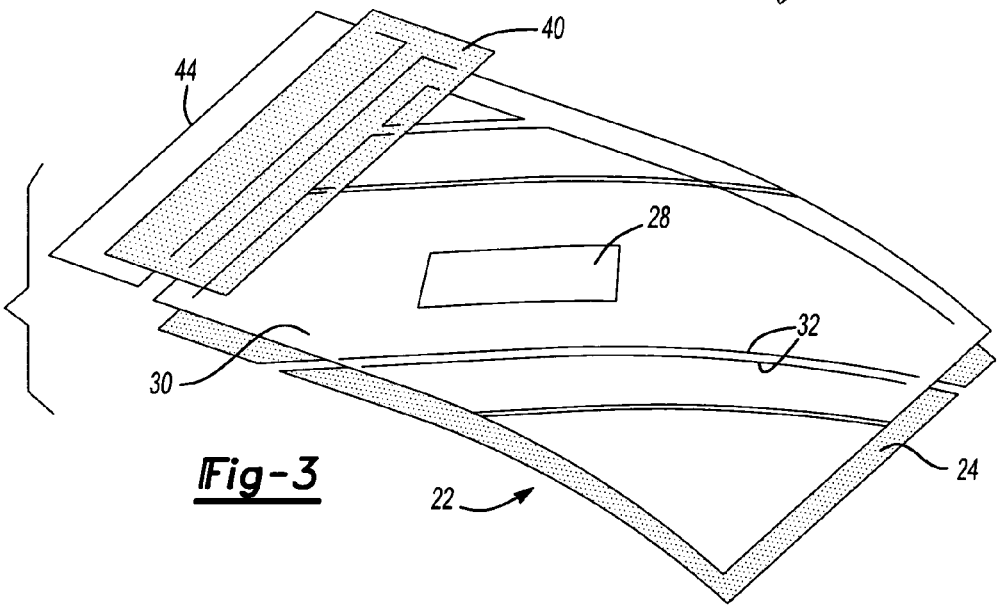
FIG. 3 is an exploded view of the preferred embodiment of the cover of the present invention.

With reference now to FIGS. 1–3, a generally rectangular cover 22 is removably and replaceably disposed around the adhesive roll 12. The cover includes a substrate 24 which is preferably constructed of paper. The substrate 24, furthermore, is spiral wound around the adhesive roll 12 and includes an adhesive release coating 26 on its inwardly facing surface. This adhesive release coating 26 minimizes or altogether eliminates the adhesion between the substrate 24 and the adhesive roll 10.

As best shown in FIG. 3, advertising or product identification graphics 28 are optionally provided on the outwardly facing surface of the substrate 24.

Still referring to FIG. 3, the cover 22 further includes an adhesive tape 30 which is spiral wound around the outwardly facing surface of the substrate 24. The adhesive tape 30, furthermore, is dimensioned so that its edges 32 abut against or are slightly spaced from each other. In doing so, the tape 30 adhesively attaches to the underlying substrate 24. Furthermore, the tape 30 is preferably clear or transparent so that indicia, if any, printed on the substrate 24 can be seen through the tape 30.

Figure 5:
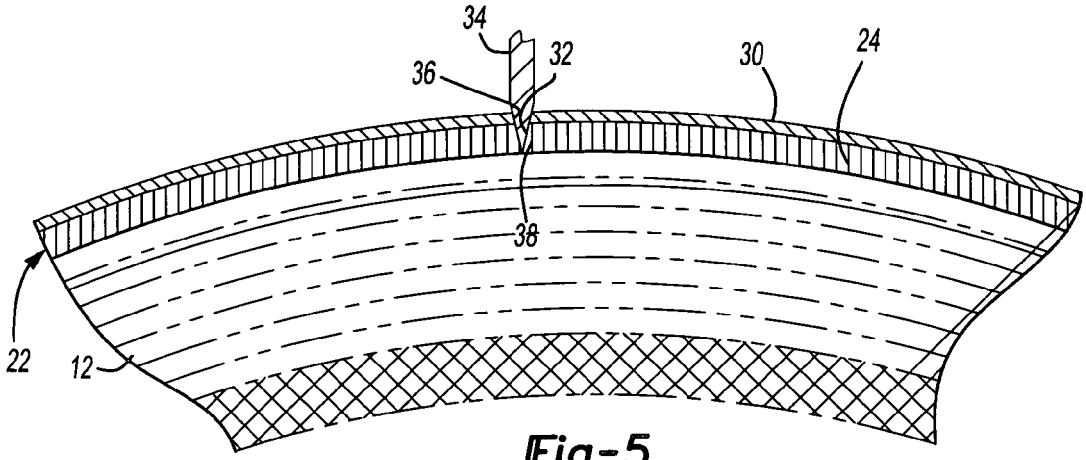
FIG. 5 is a fragmentary sectional view illustrating a portion of the manufacture of the adhesive roller assembly of the present invention.

With reference now to FIG. 5, after the backing layer 24 and adhesive tape 30 have been spiral wound around the adhesive roll 12, a longitudinally extending slit 32 is formed through the cover 22 by any conventional cutter 34. Upon completion of the slit 32, the cover 22 has two longitudinally extending abutting edges 36 and 38.

With reference now to FIGS. 3 and 6, after the slit is formed through the cover 22, a longitudinally extending adhesive retainer strip 40 having an adhesive side 42 is disposed across the abutting edges 36 and 38 of the cover 22. Simultaneously, an elongated pull-tab 44 is adhesively attached along one side of the retainer strip at a position spaced from the cover edge 36 so that a portion 46 of the adhesive side of the retainer strip 40 remains exposed.

This exposed portion 46 of the retainer strip 40 adhesively attaches to the outer surface of the cover 22 adjacent the edge 38 in order to retain the cover 22 to the adhesive roll 12. However, the pull-tab 44 facilitates the removal of the cover 22 from the roll 12 whenever desired. Furthermore, since the cover 22 is generally rectangular in shape, the cover 22 is easily removed from and replaced on the adhesive roll 12 as desired.

Figure 4:
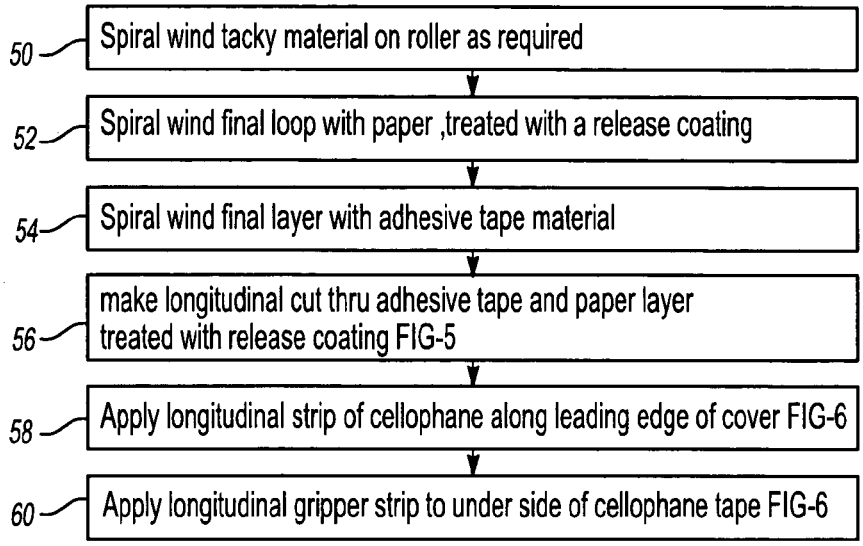
FIG. 4 is a process diagram illustrating the manufacturing process for manufacturing the adhesive roller assembly of the present invention.

With reference now to FIG. 4, the manufacturing process is summarized. At step 50, the adhesive strip having both the backing sheet and the outwardly facing adhesive coating is spiral wound into a tubular and cylindrical roll having multiple overlapping layers with one spiral winding forming each layer. After multiple layers of the adhesive strips are spiral wound into their adhesive roll, at step 52 the paper substrate 24 having an adhesive release coating on its inner side is then spiral wound around the adhesive roll. Only a single layer of the spiral wound paper substrate 24 is provided around the adhesive roll at step 52.

Thereafter, at step 54 the adhesive tape 30 is spiral wound around the paper substrate 24. Furthermore, the adhesive tape 30 is dimensioned so that its edges abut against or are slightly spaced from each other so that the adhesive tape 30 adheres to the underlying paper substrate 24. The adhesive tape 30 together with the underlying paper substrate 24 forms the cover for the adhesive roll 12.

Thereafter, at step 56 the longitudinally extending slit is formed through both the adhesive tape 30 and paper substrate 24 thus forming two abutting edges on the cover. At step 58 the longitudinally extending adhesive retainer strip 40 is disposed across the abutting edges of the cover and, thereafter or preferably simultaneously at step 60, a pull-tab 44 is adhesively attached to the retainer strip.

From the foregoing, it can be seen that the present invention provides a spiral wound adhesive roller for detritus removal which may be very inexpensively manufactured. Furthermore, since the cover for the adhesive roll is rectangular in shape, it may be easily removed from the adhesive roll whenever desired by merely pulling on the pull-tab 44 to disengage the adhesive portion 46 of the retainer strip 40 from the cover 22. After use of the adhesive roll is completed, the cover is simply and easily reattached to the adhesive roll by disposing the cover around the adhesive roll and reengaging the adhesive portion 46 of the retainer strip 40 with the outer surface of the cover 22. The cover may also be firmly wrapped around and attached to the adhesive roll even as the diameter of the adhesive roll decreases as the individual layers of the adhesive roll are removed.

Having described my invention, however, many modifications thereto will become apparent to those skilled in the art to which it pertains without deviation from the spirit of the invention as defined by the scope of the appended claims.

The invention claimed is:

1. An adhesive roller assembly for detritus removal comprising:

a tubular cylindrical adhesive roll having a plurality of overlapping layers, each layer having a backing sheet and an adhesive coating on an outwardly facing side of said backing sheet;

a cover separate from said adhesive roll removably and replaceably disposed around and having one side in contact with an outermost layer of said adhesive roll, said cover being free of adhesive on an outwardly facing side of said cover, said cover having an adhesive release coating on said one side to reduce adhesion between said cover and said outermost layer of said adhesive roll, said cover having two longitudinally extending edges positioned closely adjacent each other when said cover is disposed around said roll;

a longitudinally extending adhesive retainer strip overlying said edges of said cover which detachably secure said cover edges together; and a pull-tab adhesively attached along one side of said retainer strip.

2. The invention as defined in claim 1 wherein said overlapping layers of said adhesive roll are spiral wound.

3. The invention as defined in claim 1 wherein said cover is generally rectangular in shape.

4. The invention as defined in claim 1 wherein said cover comprises a paper layer and an adhesive tape layer.

5. The invention as defined in claim 4 wherein said paper layer and said tape layer are spiral wound.

6. The invention as defined in claim 5 wherein said tape layer comprises a clear tape layer.

7. A method of manufacturing an adhesive roller for detritus removal comprising the steps of:

spiral winding overlapping adhesive strips around a cylindrical core so that each strip forms a layer about the core, each adhesive strip having a backing layer and an adhesive coating on an outwardly facing surface of said backing layer;

spiral winding a seperate cover assembly free of adhesive on anoutwardly facing side around an outermost layer of said overlapping adhesive strips, said cover assembly having an adhesive release coating on a side of the cover assembly in contact with said adhesive strip;

forming a longitudinal slit through said cover assembly thereby forming abutting edges of said cover assembly; and applying a longitudinally extending adhesive retainer strip along and overlying said abutting edges of said cover assembly and which detachably secures said cover edges together assembly.

8. The invention as defined in claim 7 and further comprising the step of attaching a pull-tab to one side of said retainer strip.

9. The invention as defined in claim 7 wherein said step of spiral winding said cover assembly further comprises the steps of:

spiral winding a substrate having an outwardly facing side that is free of adhesive around the outermost layer of said overlapping adhesive strips; and spiral winding an adhesive tape having spaced apart edges around said substrate, said adhesive tape being dimensioned so that said adhesive tape edges are adjacent each other.

* * * * *